United States Patent [19]

Dunnell et al.

[11] 3,964,141

[45] June 22, 1976

[54] CRIMPING GEARS AND PROCESS

[75] Inventors: Alan Keith Dunnell, Pinelands, South Africa; Thomas Cyril James Wade, Kibworth-Harcourt; David Greenwood, Oadby, both of England

[73] Assignee: Imperial Chemical Industries Limited, London, England

[22] Filed: Oct. 9, 1974

[21] Appl. No.: 513,444

Related U.S. Application Data

[63] Continuation of Ser. No. 325,762, Jan. 22, 1973, abandoned.

[52] U.S. Cl. ..... 28/1.8; 28/72.15

[51] Int. Cl.[2] ..... D02G 1/14

[58] Field of Search ..... 28/1 8, 72.15

[56] References Cited

UNITED STATES PATENTS

| | | | |
|---|---|---|---|
| 3,396,445 | 8/1968 | Hopkins et al. | 28/1.8 |
| 3,462,811 | 8/1969 | Burgess et al. | 28/1.8 |
| 3,686,723 | 8/1972 | Dunnell et al. | 28/1.8 |

*Primary Examiner*—Louis K. Rimrodt
*Attorney, Agent, or Firm*—Robert J. Blanke

[57] ABSTRACT

Integral structure crimping gears having timing gear teeth and crimping gear teeth of the same outside diameter, the tooth thickness of the crimping teeth being less than the tooth thickness of the timing teeth at any given diameter of the structure.

3 Claims, 4 Drawing Figures

CRIMPING GEARS AND PROCESS

This is a continuation of application Ser. No. 325,762, filed Jan. 22, 1973, now abandoned.

The invention concerns improvments in or relating to gears for crimping textile materials and in particular gears for crimping yarn.

British Patent Specification 1,255,478 describes crimping gears comprising two or more gears in meshing engagement for the imparting of rotary motion by one or more of said gears which is driven and for the imposing of crimp to a material running therebetween in which at least one of the said gears is an integral single step structure having one set of gear teeth of greater outside diameter and the second set of gear teeth of lesser outside diameter both sets of which teeth intermesh with teeth on the other gear.

We have now found other modified crimping gears which are suitable for crimping yarn. The modified crimping gears comprise two or more gears in meshing engagement one or more of said gears being driven and in which at least one of the said gears is an integral structure having timing gear teeth and crimping gear teeth of the same outside diameter, the tooth thickness of the crimping teeth being less than the tooth thickness of the timing teeth at any given diameter of the structure.

By "timing gear teeth" we mean driving or driven gear teeth.

We also provide a process for crimping a yarn which comprises passing the yarn between the meshing gears of different tooth thickness referred to above.

Preferably, the teeth of both or all the gears are involute in shape, in order that, over the working range of the gears operative to grip the yarn during the full period of intermeshing, a substantially constant gap between the sides of the teeth, where the yarn is gripped, is maintained. The actual dimensions of the gap are determined by the thickness of the yarn to be crimped, care being taken to ensure that the said yarn is gripped to avoid slippage.

By these means, it is possible to ensure that the yarn is never pinched by the meshing teeth, so that filamentation is minimal and problems due to the wear of the gears will be minimised even if the gears are both or all made of metal.

It is pointed out that gears according to the invention, being of integral structure, are a great improvement over known gear systems in which driving pairs of gears and crimping pairs of gears are respectively mounted on two shafts. Not only are integral gears more simply and cheaply manufactured, but there is no need, as in the separated gears system, to cut the gears separately and then to assemble them on their respective shafts with extreme accuracy relative to one another, bearing in mind that the gap between the driving and crimping teeth flanks is of the order of only one to two thousandths of an inch.

According to a further embodiment of the invention, a pair of crimping gears comprises a straight spur gear and an integral gear as described above in meshing engagement.

Both gears may be made of stainless steel or even a synthetic plastic material; or alternatively the driving gear of integral construction is of stainless steel, and the driven gear is of a synthetic plastic such as "Delrin" polyoxymethylene material.

The teeth around the periphery of the gears may be regular in size and spacing, or, if novelty effects are required, the spacing may be irregular (the gears being matched in this respect) or the amplitude of the teeth may be varied around the gears.

Normally, however, regular spacing and amplitude of the teeth is desirable, but some de-phasing of the crimp is usually subsequently required and this may be brought about by subjecting the yarn to agitation by air turbulence before it is wound up. Some degree of out-of-phase in the crimp may be attained if the teeth are helically arranged around the periphery of the gear wheel, rather than with their tips parallel to the axis thereof. Preferably, with any shaped teeth, the tips are rounded.

Two embodiments of the invention will now be described with reference to the drawing filed with the provisional specification, in which.

Figure 1:
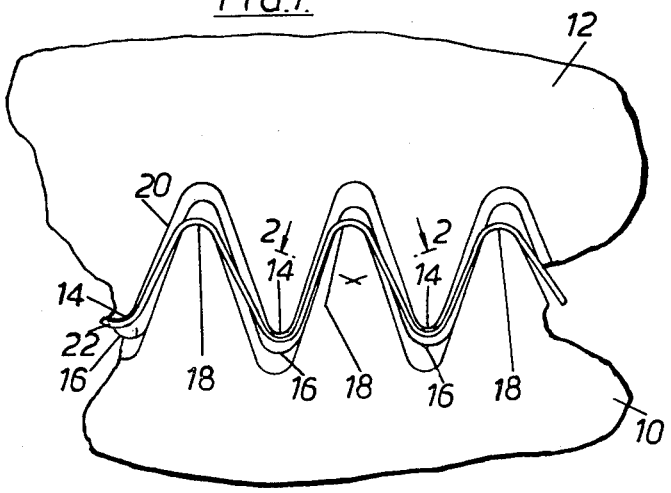
FIG. 1 is a front elevational view of an integral gear intermeshing with a straight spur gear, looking from the yarn processing end.
Figure 2:
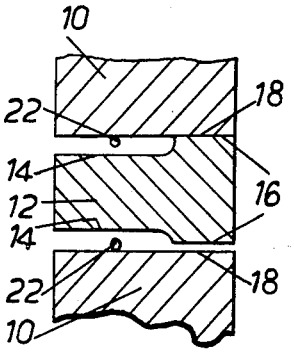
FIG. 2 is a sectional view taken on the line 2—2 of FIG. 1.

Referring to FIGS. 1 and 2, there is shown a straight spur gear 10 and an integral gear 12. The integral gear 12 has crimping teeth 14 and timing teeth 16, the tooth thickness of the crimping teeth 14 being less than the tooth thickness of the timing teeth 16 at any given diameter of the integral gear. The timing teeth 16, on the drive transmission side mesh with and engage teeth 18 on the drive transmission side of gear 10. The crimping teeth 14 mesh with but do not engage the teeth 18, there being a gap 20 between the sides of teeth 14 and the sides of teeth 18 within which lies the yarn 22 being crimped. As shown, the yarn 22 passes alternatively over the tips of teeth 18 and 14.

Figure 3:
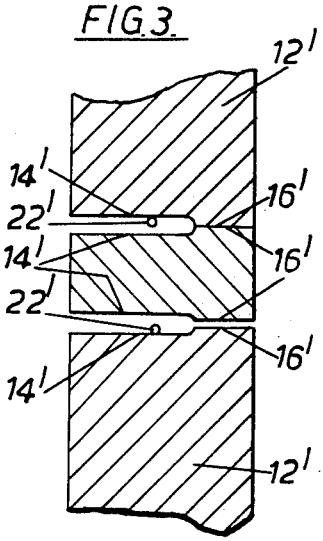
FIG. 3 is a sectional view as FIG. 2, but of two integral gears intermeshing.
Figure 4:
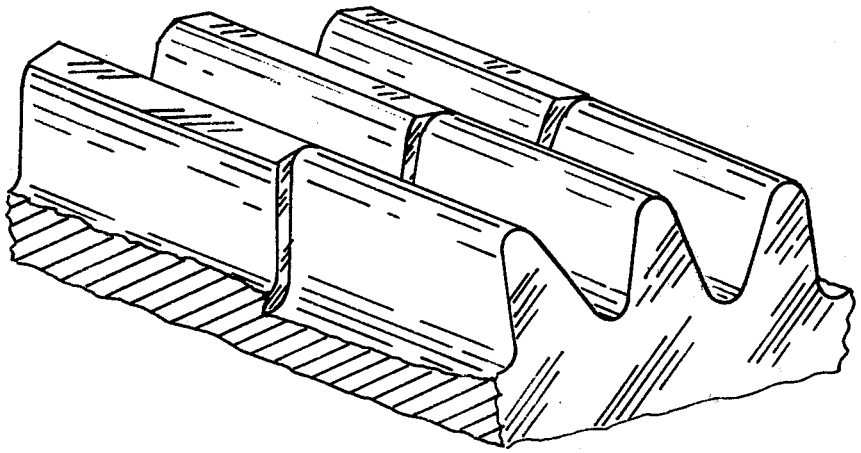
FIG. 4 is a partially broken projected view of the integral gear of FIG. 1.

In FIG. 3 the gear assembly includes two integral gears 12' each of which is constructed in the shape of the gear 12 illustrated in FIG. 1. In this embodiment the teeth 16' intermesh and engage, and the teeth 14' intermesh but do not engage. The yarn 22' passes first over the tip of a tooth 14' on one of the gears and then over the tip of a tooth 14' on the other gears.

We claim:

1. Crimping gears comprising two or more gears in meshing engagement, one or more of said gears being driven, characterized in that at least one of the said gears is an integral structure having timing gear teeth and crimping gear teeth of the same outside diameter, the tooth thickness of the crimping teeth being less than the tooth thickness of the timing teeth at any given diameter of the structure.

2. Crimping gears according to claim 1 characterized in that a straight-spur gear and an integral gear are in meshing engagement, the crimping teeth of said gears being of regular amplitude.

3. A process for crimping a yarn which comprises passing the yarn between two or more gears in meshing engagement, one or more of said gears being driven, characterized in that at least one of said gears is an integral structure having timing gear teeth and crimping gear teeth of the same outside diameter, the tooth thickness of the crimping teeth being less than the tooth thickness of the timing teeth at any given diameter of the structure, said crimping gear teeth being of regular amplitude.

* * * * *